US012098533B2

(12) United States Patent
Jin

(10) Patent No.: US 12,098,533 B2
(45) Date of Patent: Sep. 24, 2024

(54) WATER TURBINE AND ELECTRIC MOTOR HYBRID POWER SUCTION TYPE WATER-SAVING TOILET

(71) Applicant: Chunxin Jin, Luoyang (CN)

(72) Inventor: Chunxin Jin, Luoyang (CN)

( * ) Notice: Subject to any disclaimer, the term of this patent is extended or adjusted under 35 U.S.C. 154(b) by 380 days.

(21) Appl. No.: 17/424,826

(22) PCT Filed: Jan. 23, 2020

(86) PCT No.: PCT/CN2020/000025
§ 371 (c)(1),
(2) Date: Jul. 21, 2021

(87) PCT Pub. No.: WO2020/151470
PCT Pub. Date: Jul. 30, 2020

(65) Prior Publication Data

US 2022/0127831 A1 Apr. 28, 2022

(30) Foreign Application Priority Data

Jan. 23, 2019 (CN) ..... 201910065427.2

(51) Int. Cl.
*E03D 3/10* (2006.01)
*E03D 1/02* (2006.01)
*E03D 5/10* (2006.01)

(52) U.S. Cl.
CPC ..... *E03D 3/10* (2013.01); *E03D 1/02* (2013.01); *E03D 5/10* (2013.01); *E03D 2201/30* (2013.01)

(58) Field of Classification Search
CPC .... E03D 3/10; E03D 1/02; E03D 5/10; E03D 2201/30; E03D 1/003; E03D 5/01; E03D 2201/40; E03D 9/10; E03D 11/02
See application file for complete search history.

(56) References Cited

U.S. PATENT DOCUMENTS 5,502,845 A * 4/1996 Hayashi ..... E03D 11/02 4/425
2010/0212696 A1* 8/2010 Shirai ..... E03D 11/08 134/166 R

FOREIGN PATENT DOCUMENTS

CN 103422562 A * 12/2013 ..... B28B 1/002
CN 105239655 A 1/2016
(Continued)

OTHER PUBLICATIONS

International Search Report (English and Chinese) and Written Opinion (Chinese) of the International Searching Authority issued in PCT/CN2020/000025, mailed Apr. 23, 2020; ISA/CN (6 pages).

*Primary Examiner* — Christine J Skubinna
(74) *Attorney, Agent, or Firm* — Harness, Dickey & Pierce, P.L.C.

(57) ABSTRACT

A water turbine and electric motor hybrid power suction type water-saving toilet, with toilet main body comprising a hollow frame, a hollow frame water inlet, a basin bottom water injection hole and an S-shaped bend, wherein the hollow frame is located on upper part of the toilet with water injection holes distributed along the periphery towards inner side of the toilet; the hollow frame water inlet is formed in rear part of the toilet; the basin bottom water injection hole is formed in lower part of the toilet and communicates with the hollow frame water inlet through a pipe cavity attached to outer wall of the toilet; and a basin bottom water injection valve is arranged at the opening of the basin bottom water injection hole leading to the S-shaped bend and controls connection/disconnection of basin bottom water injection hole and S-shaped bend inlet section with water pumping process synchronously.

18 Claims, 7 Drawing Sheets

(56) References Cited

FOREIGN PATENT DOCUMENTS

| | | | | |
|---|---|---|---|---|
| CN | 106759757 | A | * | 5/2017 |
| CN | 207633456 | U | | 7/2018 |
| CN | 108396840 | A | | 8/2018 |
| CN | 109736401 | A | | 5/2019 |
| JP | 2007016501 | A | | 1/2007 |

* cited by examiner

WATER TURBINE AND ELECTRIC MOTOR HYBRID POWER SUCTION TYPE WATER-SAVING TOILET

CROSS REFERENCE TO RELATED APPLICATION(S)

This patent application is a 371 U.S. National Phase of International Application No. PCT/CN2020/000025, filed on Jan. 23, 2020, which claims the benefit and priority of Chinese Patent Application No. 201910065427.2, filed on Jan. 23, 2019. The disclosure of the above applications are incorporated by reference herein in their entirety as part of the present application.

TECHNICAL FIELD

The present disclosure relates to a suction type toilet with a water turbine or an electric motor as power, and a water turbine and electric motor hybrid power suction type toilet which is completely the same in the part of toilet main body and can be obtained by switching a plurality of related components when the power is changed from the water turbine to the electric motor or from the electric motor to the water turbine.

BACKGROUND ART

A pipeline, leading to a sewer, of a toilet basin is provided with a bent structure capable of retaining sealing water and isolating odor of the sewer, and is commonly known as an S-shaped bend. A traditional toilet has two technical defects. Firstly, water resources are greatly wasted, and the fundamental reason is that the traditional toilet is cleaned in a flushing mode, namely, moving clear water is used for impacting a mixture of excrement and urine as wells as sealing water at the position of the S-shaped bend; in this way, clear water and excrement liquid (the mixture of excrement and urine as well as sealing water is called excrement liquid for short) must be mixed in a large scale, in order to ensure that sealing water left at the S-shaped bend is close to clean water after the toilet is flushed, the water consumption must be large, and the larger the water consumption is, the better the effect is. Secondly, the S-shaped bend pipeline is long and zigzag, so that the structure is easy to block, water scale is continuously formed after the pipeline is used for a long time and is difficult to remove, the effective water passing section of the pipeline is continuously reduced, the occurrence rate of blocking is continuously increased, and the water consumption for cleaning the toilet is continuously increased.

SUMMARY

In order to achieve sustainable development, water resource waste must be completely eradicated, and a traditional toilet causes the maximum waste of domestic water. The present disclosure aims to overcome the great waste of water resources of the traditional toilet, and the idea of the present disclosure is to reduce the mixing of clear water and excrement liquid to the greatest extent. In the pipeline or the channel, the water at the rear part always follows behind the water at the front part in sequence, so that the water at the front part and the water at the rear part are not mixed. Under this inspiration, when the toilet is cleaned, in order to ensure that clear water and excrement liquid are not mixed, power equipment must be used, a suction mode is adopted, the excrement liquid is forced to run in front, the clear water follows the excrement liquid, and the excrement liquid and the clear water leave the toilet in sequence and fall into the sewer in this mode. The water turbine is firstly selected as the power equipment, the water turbine is the most durable in various power machines, an impeller and a rotating shaft of the water turbine can be completely sealed in the water system, no sealing facility needs to be additionally arranged at the rotating shaft, the water turbine can directly utilize energy of tap water, and the energy of the tap water completely depends on pressure. At present, urbanization is continuously accelerated, new buildings are all high-rise buildings, and tap water needs to be secondarily pressurized, so that a larger space is provided for the novel toilet by taking the water turbine as power. However, due to the fact that the tail end of a tap water pipe network and a water supply pipe network through adoption in indigenous methods in vast rural areas may still be insufficient in pressure, in order to enable a novel water-saving toilet to be universally applicable, a water turbine has to be replaced by an electric motor in places where the tap water supply pipe network is insufficient in pressure. No matter whether the water turbine or the electric motor is used as the power, the main body part of the toilet is completely the same, and when the two kinds of power are replaced, only several related components need to be switched. Therefore, the present disclosure provides a water turbine or an electric motor or a water turbine and electric motor hybrid power suction type toilet, the water turbine or the electric motor can be independently used as a power source, the water turbine and the electric motor can also be selected both, and under different conditions, the electric motor or the water turbine can be manually switched to be used as the power source according to needs. By taking the water turbine or the electric motor as power, the novel water-saving toilet provided by the present disclosure can form the effect at the position of the S-shaped bend that the excrement liquid runs in front and the clear water follows, and the excrement liquid and the clear water fall into the sewer in sequence. Therefore, mixing of the excrement liquid and the clear water is sufficiently reduced, and the effect is that the toilet is flushed clean and the water is saved. The water consumption for urine is less than 1.5 liters, and the water consumption for excrement is less than two liters. People may only defecate once and urinate many times in one day, so that the average water consumption of the toilet each time is no more than 1.5 liters, which is one fourth of the current national forced water consumption standard of 6 liters. The present disclosure further aims to thoroughly change the long and zigzag form of the S-shaped bent pipeline of the traditional toilet, so that the blocking is impossible, and the effect of a water turbine or an electric motor in a water saving mechanism is fully exerted. The present disclosure also provides greater convenience for the user to select the power, and the initial selection can be changed as required even if the toilet is purchased home and installed in place by the user.

The technical scheme of the present disclosure is as follows: according to a power suction type toilet based on a water turbine or an electric motor, a shell of the water turbine comprises a volute chamber (11, 21) for accommodating an impeller and a shaft retaining body (12) for supporting an impeller rotating shaft (18, 31, 413), and the volute chamber (11, 21) and the shaft retaining body (12) are fixed into a whole. A capping screw head (19) and a sealing rubber pad (110) are arranged at the upper end of a shaft hole of the shaft retaining body (12) and used for axially limiting the impeller rotating shaft (18, 31, 413) and sealing the shaft hole respectively.

Further, a tap water inlet (13, 23, 49) is formed in the direction tangential to the side wall of the volute chamber (11, 21), and a volute chamber water outlet (14, 410) is formed in one side of the upper part of the volute chamber (11, 21) from the shaft retaining body (12).

Further, the lower part of the volute chamber (11, 21) is provided with an assembling external thread (111) matched with an assembling internal and an assembling rubber gasket (112), wherein the assembling external thread (111) is matched with the assembling internal thread at the upper port of the S-shaped bend kettle belly accommodating body (47).

The impeller of the water turbine is sealed in the volute chamber (11 and 21), the upper part of the impeller rotating shaft (18, 31, 413) which is fixed on an impeller chassis (15) and rotates synchronously with the impeller extends into the shaft hole of the shaft retaining body (12), the lower part of the impeller rotating shaft (18, 31, 413) extends into the S-shaped bend through the volute chamber (11, 21) of the water turbine, and a funnel plugging body (33, 414) and a propeller (32, 411) are sequentially installed at the lower end of the impeller rotating shaft (18, 31, 413) from top to bottom. The funnel plugging body (33, 414) and the propeller (32, 411) are fixed into a whole. The funnel plugging body (33, 414) is a circular sleeve with a slightly tapered lower part, the upper part larger and the lower part smaller, and with a bottom at the lower part, and three to four strip-shaped rubber fins (34) are evenly distributed along a periphery of the funnel plugging body (33, 414) at a position of an upper part of the funnel plugging body (33, 414) right facing the S-shaped bend horizontal overflow port section (46) The upper part of the rubber fin (34) straightly extends along the circular sleeve, and the lower part of the rubber fin (34) is bent around the circular sleeve towards one side such that an upward propulsion effect is produced like the propeller.

Further, the impeller comprises an impeller chassis (15), a blade (17, 22) and a blade upper cover (16) which are fixed into a whole. The blade (17, 22) is a curved surface of which the generatrix is perpendicular to the impeller chassis (15).

Further, the blade upper cover (16) is a conical surface, so that the height of a water passage formed by the adjacent blades is gradually increased from outside to inside, so that gradual narrowing of the channel from outside to inside can be compensated, and the cross-sectional area of the channel is kept unchanged.

The propeller (32, 411) installed at the lower part of the impeller rotating shaft (18, 31, 413) is positioned at the lower part of an S-shaped bend propeller position section (45). A sharp cutting edge is arranged in front of all blades of the propeller, so that the sharp cutting edge has an upward propelling function and also has a cutting function.

According to the power suction type toilet based on a water turbine or an electric motor, all installation objects and installation positions of an electric motor shaft are completely the same as those of a water turbine shaft from top to bottom. The end face of the end, extending out the rotating shaft, of the electric motor is also provided with an assembling external thread (111) and an assembling rubber gasket (112), wherein the assembling external thread (111) is matched with the assembling internal thread at the upper port of the S-shaped bend kettle belly accommodating body (47).

Further, different from the water turbine, the electric motor body of the electric motor must be exposed outside the water system, so a sealing device is arranged at the joint of the electric motor shaft and the electric motor body.

The upper part of the toilet main body is provided with a hollow frame (41), the hollow frame (41) faces the inner side of a basin, and uniformly distributed fine and dense water injection holes are formed in the periphery of the hollow frame (41). A hollow frame water inlet (42) is formed in the outer side of the basin at the rear part of the toilet. The hollow frame water inlet (42) does not communicate with the hollow frame (41) directly at the rear part of the toilet, but is connected with a pipe cavity (419) attached to the outer wall of the toilet, extends to a certain position from back to front along the outer wall of the toilet in a bilateral symmetry manner and then is divided into two paths respectively led upwards to the hollow frame (41) and led downwards to the basin bottom water injection hole (43). The proper position can indicate that the pipe cavity (419) and the part leading to the hollow frame (41) can be hidden, so that the attractiveness or appearance is not influenced. The pipe cavity (419) is provided with a basin bottom water injection valve (415) and a flow rectifying device (412) at the basin bottom water injection hole (43).

Further, a machine cabin for accommodating the water turbine or the electric motor is arranged on the rear part of the toilet main body. When the water turbine is used as power, the machine cabin for accommodating the water turbine is arranged, and a machine cabin cover is arranged above the machine cabin; and when the electric motor is used as power, the machine cabin for accommodating the electric motor is arranged, and a water tank is arranged at the position of the machine cabin cover, and a water outlet (81) and a water drain valve (82) are arranged in the water tank.

Further, a transmission rod (83) capable of lifting the water drain valve (82) through a lever device is arranged outside the water tank, and a plastic protruding part (84) is arranged on the transmission rod (83).

Further, a moving contact (85) and a static contact (86), which are associated with the plastic protruding part (84), of an electric motor switch are further arranged outside the water tank. The plastic protruding part (84) is not limited to a plastic material, and may be a protruding part of any material.

The lower part of the toilet is provided with an S-shaped bend different from a traditional toilet, and according to different functions, the whole S-shaped bend is divided into five parts including an S-shaped bend inlet section (44), an S-shaped bend propeller position section (45), an S-shaped bend horizontal overflow port section (46), an S-shaped bend kettle belly accommodating body (47) and an S-shaped bend connecting sewer pipe network section (48).

Further, the S-shaped bend propeller position section (45) is a conical pipe with a large upper part and a small lower part. The S-shaped bend horizontal overflow port section (46) is an inclined circular pipe with one half cut into a horizontal overflow port, and the water turbine rotates clockwise to cut the right half and rotates anticlockwise to cut the left half, so that the cut half is cut to form a horizontal overflow port (51), and the non-cut half forms a flow deflector (52). According to the principle of connecting vessels, the highest water level of sealing water is determined by the position of the horizontal overflow port (51).

Further, the upper end and the lower end of the S-shaped bend kettle belly accommodating body (47) are combined with the upper end and the lower end of the S-shaped bend horizontal overflow port section (46) respectively. The inner diameter of the S-shaped bend kettle belly accommodating body (47) is larger than the outer diameter of the S-shaped bend horizontal overflow port section (46), a cavity is formed between the S-shaped bend kettle belly accommodating body (47) and the S-shaped bend horizontal overflow port section (46), the cavity communicates with the horizontal overflow port (51) and also communicates with the S-shaped bend connecting sewer pipe network section (48).

Further, a component capable of mounting or dismounting the water turbine or the electric motor is arranged at an upper port of the S-shaped bend kettle belly accommodating body (47), and the component can be an assembling internal thread, so that the upper port becomes an openable part of the S-shaped bend.

Further, the propeller (32, 411) installed at the lower part of the impeller rotating shaft (18, 31, 413) is positioned at the lower part of the S-shaped bend propeller position section (45). A sharp cutting edge is arranged in front of all blades of the propeller, so that the sharp cutting edge has a propelling function and also has a cutting function.

The volute chamber water outlet (14, 410) of the water turbine is connected with the hollow frame water inlet (42) of the toilet through a hose or other similar objects.

In order to fully improve the energy utilization efficiency of tap water, as shown in FIG. 6, a pressure energy relay device is arranged at the joint of a tap water pipe network and the tap water inlet (13, 23, 49) of the water turbine. The pressure energy relay device comprises a pressure tank (61), a water mask (62), a tap water pipe network connector (63), a tap water supply valve (64) and a valve body water outlet (65). The tap water pipe network connector (63) is connected with the tap water pipe network. The valve body water outlet (65) is connected with the tap water inlet (13, 23, 49) of the water turbine through a hose or similar objects. The water mask (62) is a small cylinder with a closed upper part and a windowed periphery.

A pedal valve handle (416) is arranged on the lower part of the front of the toilet, and a valve line a (417) and a valve line b (418) extend out of the control valve handle (416) at the same time, wherein the valve line b (418) is connected with the basin bottom water injection valve (415), when the water turbine is used as power, the valve line a (417) is connected with the tap water supply valve (64), and when the electric motor is used as power, the valve line a (417) is connected with the lower end of the transmission rod (83). When the pedal valve handle (416) is treaded, under the traction of the valve line a (417) and the valve line b (418), the tap water supply valve (64) and the basin bottom water injection valve (415) as well as the water drain valve (82) and the basin bottom water injection valve (415) can be opened simultaneously. When the water turbine is used as power, the pedal valve handle can enable the tap water supply valve (64) and the basin bottom water injection valve (415) to be synchronously opened and closed. When the electric motor is used as power, the pedal valve handle can enable the electric motor, the water drain valve (82) and the basin bottom water injection valve (415) to be synchronously opened and closed. The control valve is controlled by adopting valve lines of mechanical power, and can also be controlled by adopting an electric button in an electromagnetic or electronic mode.

BRIEF DESCRIPTION OF THE DRAWINGS

The present disclosure is further described in conjunction with the attached figures and embodiments.

DETAILED DESCRIPTION OF THE EMBODIMENTS

The present disclosure aims to overcome the technical defects that tap water resources for a traditional toilet are greatly wasted and effective service life of the toilet is shortened due to the fact that an S-shaped bend cannot be opened, clamped foreign matters cannot be taken out, water scale cannot be removed and the like. Provided is a water turbine power suction type toilet, tap water drives a water turbine, the water turbine drives a propeller, and a mixture of excrement and urine as well as sealing water at the sealing position of an S-shaped bend is pumped into a sewer. According to the novel toilet, energy of tap water is fully utilized, so that excrement can be easily smashed and sent out of the S-shaped bend. Tap water firstly flows through the water turbine to transfer energy to an impeller, and then enters a basin through water injection holes in the hollow frame of the toilet and a basin bottom water injection hole. Therefore, the effect that the mixture of excrement and urine as well as sealing water is continuously pumped out in front and clear water continuously and sequentially followed is achieved at the position of the S-shaped bend. Therefore, mixing of clear water with the mixture of excrement and urine as well as sealing water is fully avoided, so that the flushing is thorough, and water is saved to the maximum extent. Therefore, scaling is unlikely to occur due to thorough flushing. The installation position of the water turbine becomes an openable position of the S-shaped bend, and even if scaling or clamping of foreign matters occurs, the scalings or foreign matters are convenient to be removed. The novel toilet completely changes long and zigzag form of the S-shaped bend of the traditional toilet, so that blocking is impossible. A main body of the novel toilet, namely a ceramic part, can be used permanently.

The water turbine power suction type toilet is superior to the traditional toilet because the water turbine power suction type toilet can fully utilize energy of tap water and reduce mixing of clear water as well as excrement and urine as much as possible, and therefore efficient water saving is achieved. The key to achieving all the above is not only scientific use of the water turbine, but also all-around innovation of a toilet main body.

Figure 4:
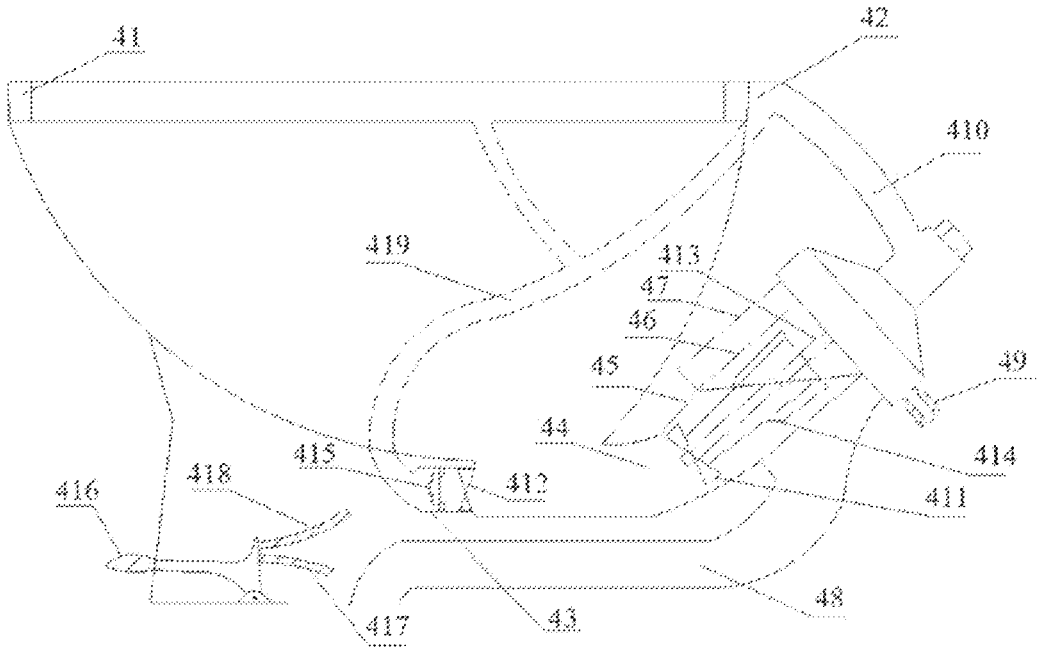
FIG. 4 is a schematic diagram of combined installation of a water turbine, a funnel plugging body, a propeller, a basin bottom water injection valve, a flow rectifying device, a pedal valve and a toilet main body.

As shown in FIG. 4, the upper part of the toilet main body is provided with a hollow frame (41), the hollow frame (41) faces the inner side of the basin, and uniformly distributed fine and dense water injection holes are formed in the periphery of the hollow frame (41). A hollow frame water inlet (42) is formed in the outer side of the basin at the rear part of the toilet. The hollow frame water inlet (42) does not communicates with the hollow frame (41) directly at the rear part of the toilet, but is connected with a pipe cavity (419) attached to the outer wall of the toilet, extends to a certain position from back to front along the outer wall of the toilet in a bilateral symmetry manner and then is divided into two paths respectively led upwards to the hollow frame (41) and led downwards to the basin bottom water injection hole (43). The proper position can indicate that the pipe cavity (419) and the part leading to the hollow frame (41) can be hidden, so that the attractiveness is not influenced. A basin bottom water injection valve (415) and a flow rectifying device (412) are arranged at the basin bottom water injection hole (43), and are sequentially arranged from inside to outside relative to the pipe cavity (419). The flow rectifying device (412) can be a rectifying impeller, such as a fixed propeller, or a spherical circular baffle, similar to a shower head, with densely distributed small holes, and the convex surface of the spherical surface faces outwards and is used for decelerating and expanding water flowing out of the basin bottom water injection valve (415).

The lower part of the toilet is provided with an S-shaped bend different from a traditional toilet, and according to different functions, the whole S-shaped bend is divided into five parts including an S-shaped bend inlet section (44), an S-shaped bend propeller position section (45), an S-shaped bend horizontal overflow port section (46), an S-shaped bend kettle belly accommodating body (47) and an S-shaped bend connecting sewer pipe network section (48).

Figure 5:
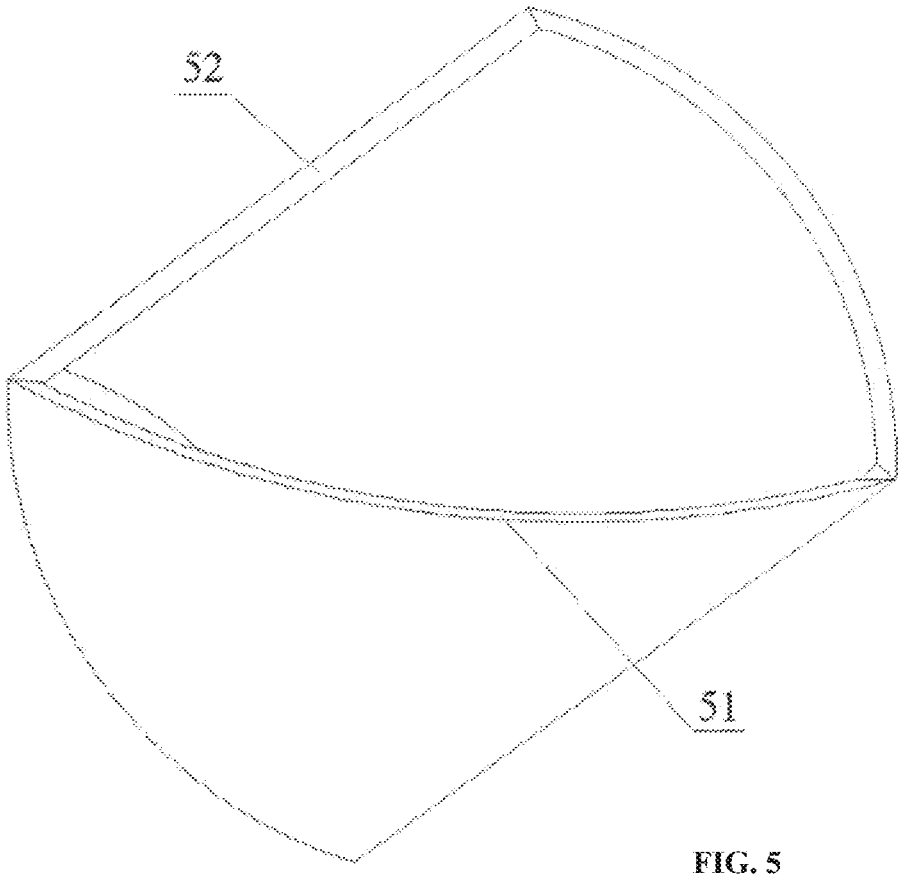
FIG. 5 is a real diagram of an S-shaped bend horizontal overflow port section in the present disclosure.

The S-shaped bend propeller position section (45) is a conical pipe with a large upper part and a small lower part. As shown in FIG. 5, the S-shaped bend horizontal overflow port section (46) is an inclined circular pipe with one half cut into a horizontal overflow port, and the water turbine rotates clockwise to cut the right half and rotates anticlockwise to cut the left half, so that the cut half is cut to form a horizontal overflow port (51), and the non-cut half forms a flow deflector (52). According to the principle of connecting vessels, the highest water level of sealing water is determined by the position of the horizontal overflow port (51).

The upper end and the lower end of the S-shaped bend kettle belly accommodating body (47) are combined with the upper end and the lower end of the S-shaped bend horizontal overflow port section (46) respectively. The inner diameter of the S-shaped bend kettle belly accommodating body (47) is larger than the outer diameter of the S-shaped bend horizontal overflow port section (46), a cavity is formed between the S-shaped bend kettle belly accommodating body (47) and the S-shaped bend horizontal overflow port section (46), the cavity communicates with the horizontal overflow port (51) and also communicates with the S-shaped bend connecting sewer pipe network section (48).

Figure 1:
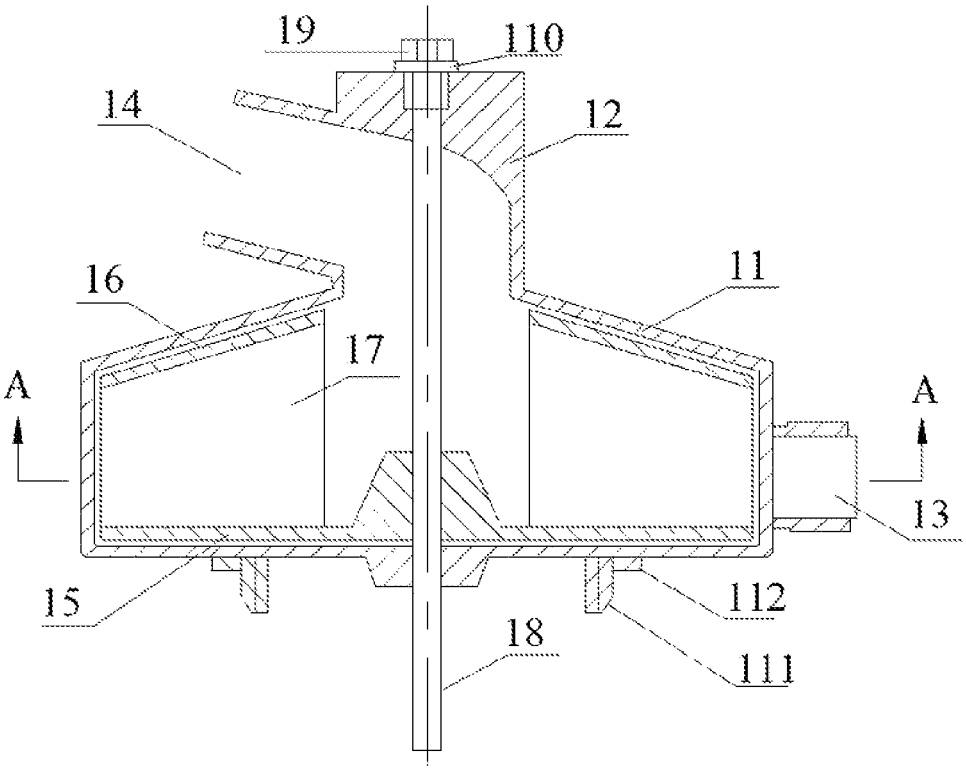
FIG. 1 is a front section view of a water turbine which is a main component of the present disclosure.
Figure 2:
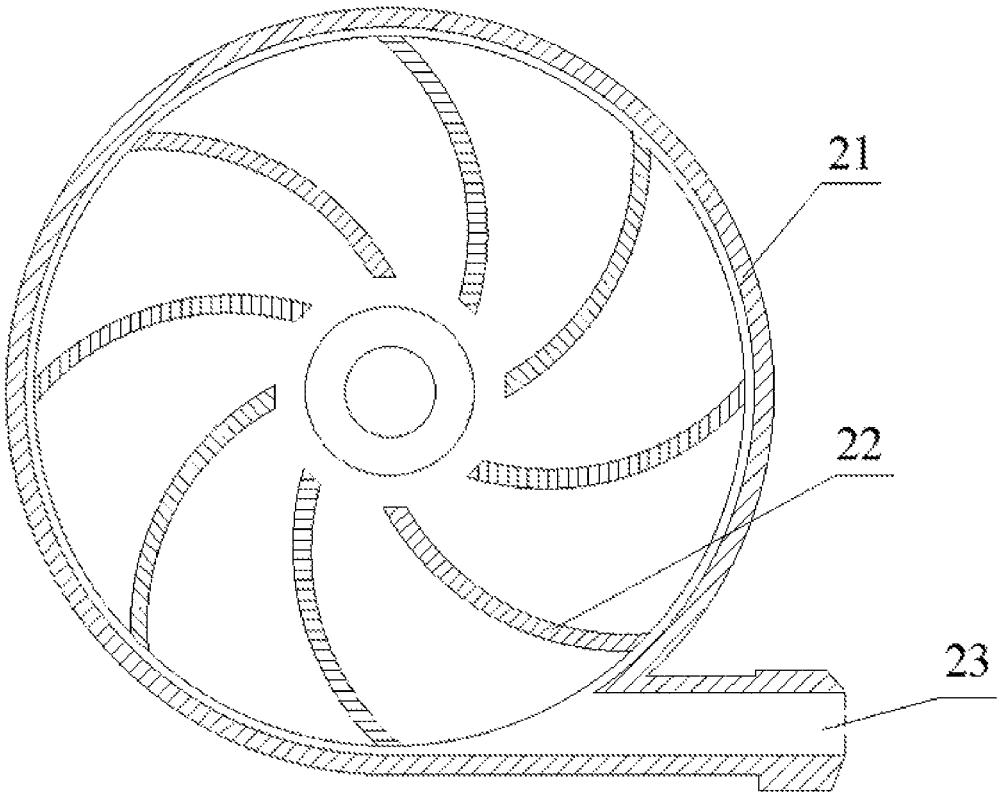
FIG. 2 is a section view of a water turbine vertical to a rotating shaft along a section line A-A in the present disclosure.
Figure 3:
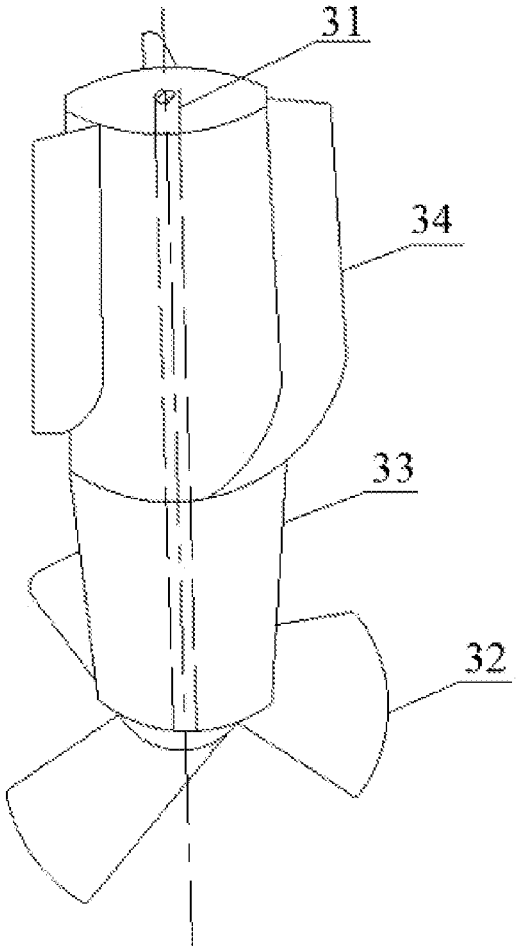
FIG. 3 is a real diagram of a funnel plugging body and a propeller installed below an impeller rotating shaft of a water turbine or an electric motor rotating shaft in the present disclosure.

The upper part of the S-shaped bend kettle belly accommodating body (47) is provided with a component capable of mounting or dismounting the water turbine, so that the upper part becomes an openable part of the S-shaped bend. According to the water turbine as shown in FIG. 1, a shell of the water turbine comprises a volute chamber (11, 21) for accommodating an impeller and a shaft retaining body (12) for supporting an impeller rotating shaft (18, 31, 413), and the volute chamber (11, 21) and the shaft retaining body (12) are fixed into a whole. A capping screw head (19) and a sealing rubber pad (110) are arranged at the upper end of a shaft hole of the shaft retaining body (12) to be used for axially limiting the impeller rotating shaft (18, 31, 413) and sealing the shaft hole.

A tap water inlet (13, 23, 49) is formed in the direction tangential to the side wall of the volute chamber (11, 21), and a volute chamber water outlet (14, 410) is formed in one side of the upper part of the volute chamber (11, 21) from the shaft retaining body (12).

Tap water in the volute chamber (11, 21) transfers most of kinetic energy to the impeller, and the flow velocity v2 at the volute chamber water outlet (14, 410) is much smaller than that v1 at the tap water inlet (13, 23, 49). According to the flow continuity principle $v1s1=v2s2$, the cross-sectional area s2 of the volute chamber water outlet (14, 410) is much larger than that s1 of the tap water inlet (13, 23, 49).

The impeller of the water turbine is sealed in the volute chamber (11, 21), and the impeller comprises an impeller chassis (15), a blade (17, 22) and a blade upper cover (16) which are fixed into a whole. The blade (17, 22) is a curved surface of which the generatrix is perpendicular to the impeller chassis (15). The blade upper cover (16) is a conical surface, so that the height of a water passage formed by the adjacent blades is gradually increased from outside to inside, so that gradual narrowing of the channel from outside to inside can be compensated, and the cross-sectional area of the channel is kept unchanged.

The upper part of impeller rotating shaft (18, 31, 413) which is fixed to an impeller chassis (15) and rotates synchronously with the impeller extends into the shaft retaining body (12), the lower part of the impeller rotating shaft (18, 31 and 413) penetrates through the volute chamber (11, 21) of the water turbine, and a funnel plugging body (33, 414) and a propeller (32 and 411) are sequentially installed at the lower end of the impeller rotating shaft (18, 31, 413) from top to bottom. The funnel plugging body (33, 414) and the propeller (32, 411) are fixed into a whole.

The funnel plugging body (33, 414) is a slightly tapered circular sleeve with a larger upper part and a smaller lower part, and as shown in FIG. 4, three to four strip-shaped rubber fins (34) are uniformly distributed along the periphery of the funnel plugging body (33, 414) at a position of an upper part of the funnel plugging body (33, 414) right facing the S-shaped bend horizontal overflow port section (46).

The propeller (32, 411) installed at the lower part of the impeller rotating shaft (18, 31, 413) is positioned at the lower part of the S-shaped bend propeller position section (45). A sharp cutting edge is arranged in front of all blades of the propeller, so that the sharp cutting edge has a propelling function and also has a cutting function.

The volute chamber water outlet (14, 410) of the water turbine is connected with the hollow frame water inlet (42) of the toilet through a hose or other similar objects.

Wherein, the capping screw head (19) not only has an axial limiting effect on the impeller rotating shaft, but also facilitates adjustment of an axial gap, so that the impeller rotating shaft rotates easily. The sealing rubber pad can completely seal the impeller rotating shaft in the water system. The scientific use of the water turbines is as follows: the water turbines in all power machines are most durable and not easy to damage, and can be completely sealed in the water system, so that the worry of water leakage and electric leakage which may occur when an electric motor is used does not exist, and the operation is safe and reliable.

The water turbine power suction type toilet is superior to the traditional toilet also because toilet completely changes long and zigzag form of the S-shaped bend of the traditional toilet, so that blocking is impossible. As shown in FIG. 4, according to different functions, the whole S-shaped bend is divided into five parts including an S-shaped bend inlet section (44), an S-shaped bend propeller position section (45), an S-shaped bend horizontal overflow port section (46), an S-shaped bend kettle belly accommodating body (47) and an S-shaped bend connecting sewer pipe network section (48). In order to facilitate excrement to pass through the S-shaped bend, the S-shaped bend propeller position section (45) is specially made into a conical pipe with a large upper part and a small lower part. In order to retain the sealing water without increasing the propulsion distance of the propeller (411) (the propulsion distance is set to be the length of the propeller position section (45)), the S-shaped bend horizontal overflow port section (46) is specially provided. According to the principle of connecting vessels, the highest water level of sealing water is determined by the position of the horizontal overflow port (51). The height of this water level is crucial because the sealing water has three functions: firstly, the odor of the sewer is isolated; secondly, buoyancy is generated on the excrement, the excrement is almost in a suspended state in water, and enough sealing water can prevent the excrement from being overlapped and bonded up and down to become a blocking factor; and thirdly, the excrement is diluted, and when the toilet is flushed, the excrement and the sealing water reach the propeller together, and continuous process of smashing, diluting and pushing is carried out. The S-shaped bend horizontal overflow port section retains the sealing water, but does not increase the propulsion distance of the propeller (411). Because under the action of the propeller (411), the propelled fluid ascends along with rotating, passes through the S-shaped bend propeller position section (45) and is immediately thrown into the kettle belly accommodating body (47) through the horizontal overflow port (51) under the combined action of the rubber fins (34) and the flow deflector (52), and the propulsion distance is the length of the propeller position section (45). Once the excrement entering the S-shaped bend kettle belly accommodating body (47) is smashed and diluted, the excrement automatically falls into the sewer. Therefore, blocking becomes impossible.

The structure provided with the S-shaped bend horizontal overflow port section (46) and the S-shaped bend kettle belly accommodating body (47) further has the effect that when the toilet is flushed, almost no water exists above the propeller (411), so that backflow does not occur, and sufficient water saving is more facilitated. On the contrary, if a complete upstream pipeline exists above the propeller (411), the water in the upstream pipeline inevitably returns to the sealing position of the S-shaped bend after the toilet is flushed, and in order to enable the return water to be completely clear water, the time to flush the toilet needs to be increased, and thus more water is used undoubtedly.

In all-round innovation of the toilet main body, besides thorough transformation for the S-shaped bend, the crucial transformation is that the basin bottom water injection valve (415) and the flow rectifying device (412) are arranged at the basin bottom water injection hole (43). A pedal valve handle (416) is arranged on the lower part in front of the toilet, and a valve line a (417) and a valve line b (418) extend out of the valve handle at the same time, wherein the valve line a (417) is connected with the tap water supply valve (64), and the valve line b (418) is connected with the basin bottom water injection valve (415). When the pedal valve handle (416) is treaded, under the traction of the valve line a (417) and the valve line b (418), the tap water supply valve (64) and the basin bottom water injection valve (415) can be opened simultaneously. It should be noted that the pedal valve handle (416) is not limited to being arranged on the lower part in the front of the toilet and is also not limited to being in the form of a pedal valve handle, and a manually pressed or any other form of control valve handle can be adopted, for example, an electric button in an electronic or electromagnetic mode is arranged at any appropriate position of the toilet, as long as synchronous control of the tap water supply valve (64) and the basin bottom water injection valve (415) can be realized conveniently. As shown in FIG. 4, when the pedal valve handle (416) is treaded, under the traction of the valve line a (417), the tap water supply valve (64) (not shown) is opened, tap water enters the volute chamber of the water turbine through the tap water inlet (49) of the water turbine, kinetic energy is transmitted to the impeller, then the tap water flows out of the volute chamber water outlet (410), and then the tap water reaches the hollow frame (41) and the basin bottom water injection hole (43) through the hollow frame water inlet (42). We wish that the mixture of excrement and urine as well as sealing water is continuously pumped in front and enters the sewer pipe network section (48), and tap water, namely clear water, continuously follows in sequence, so that the mixing of the clear water and the mixture of excrement and urine as well as sealing water is reduced to the greatest extent. The situation for achieving the desire is complex, and the water turbine needs to have extremely high suction force due to the fact that excrement and urine need to be taken into consideration at the same time. Therefore the working process of the water turbine is divided into two stages. In the first stage, the working object of the water turbine is the mixture of all excrement and urine as well as sealing water, and due to the fact that the amount of the working object is large, the S-shaped bend inlet section (44) is deeply submerged below the liquid level, so that the high power of the water turbine is fully guaranteed. The specific process is as follows: the tap water supply valve (64) is opened, tap water drives the water turbine to rotate, the propeller at the lower end of the impeller rotating shaft is driven to rotate, a suction function is generated, and most of the mixture of excrement and urine as well as sealing water is sucked away instantly (most of the mixture of excrement and urine as well as sealing water cannot be completely sucked away due to the fact that the suction function is achieved by means of atmospheric pressure; and when the liquid level is decreased below the upper edge of the S-shaped bend inlet section (44), air enters immediately, and the suction function disappears immediately). At this time, tap water which can be injected into the basin after the water turbine is pushed, namely clear water, cannot reach the basin. In the second stage, tap water, namely clear water, is continuously injected into the basin from the water injection holes of the hollow frame (41), so that the suction function of the water turbine is recovered after the residual part of excrement and urine as well as sealing water is supplemented. The mixing of tap water, namely clear water, excrement and urine as well as sealing water can only occur in the second stage, and whether the mixing can be reduced or not is the key point of the second stage. When tap water injected from the water injection holes in the periphery of the hollow frame (41), namely clear water, reaches the S-shaped bend inlet section (44), the flowing direction of the tap water is inconsistent with the flowing direction caused at the S-shaped bend inlet section (44) due to suction of the water turbine, and the tap water is easily mixed with residues of excrement and urine as well as sealing water. Especially in the traditional mode, clear water injected from the water injection holes in the hollow frame (41) on the rear part of the toilet reaches the S-shaped bend inlet section (44) first, and the flowing direction is almost opposite to the flowing direction caused by the suction of the water turbine, so that the clear water can be mixed with residues of excrement and urine as well as sealing water more easily. Therefore, the hollow frame water inlet (42) does not communicate with the hollow frame (41) at the rear part of the toilet directly, but is connected with a pipe cavity (419) attached to the outer wall of the toilet, extends to a certain position from back to front along the outer wall of the toilet in a bilateral symmetry manner and then is divided each into two paths respectively led upwards to the hollow frame (41) and led downwards to the basin bottom water injection hole (43), which is just in order to decompose this flow of water, improve the water injection mode of injected clear water into the toilet by the hollow frame (41), and reduce the mixing said above. In addition, when tap water, namely clear water, injected from the basin bottom water injection hole (43) reaches the S-shaped bend inlet section (44), the flowing direction of the tap water is consistent with the flowing direction caused at the S-shaped inlet section (44) due to the suction of the water turbine, but the tap water is trickles and is high in speed, and mixing can still occur when the tap water, namely clear water, is inserted into the residues of excrement and urine as well as sealing water like a sharp arrow instead of being sequentially followed. The solution is that the flow rectifying device (412), which can be a rectifying impeller, is arranged at the basin bottom water injection hole (43). A fixed propeller can be adopted as the rectifying impeller, trickles can be changed into a rotating fluid after passing through the rectifying impeller, due to the centrifugal effect of rotation, the trickles are not like an arrow any more, the speed is reduced, the trickles are spread to fill a channel leading to the S-shaped bend inlet section (44), and the residues of excrement and urine as well as sealing water located in front are continuously pushed forward, therefore the effect of sequential following described above is shown. In conclusion, tap water, namely clear water, passing through the water turbine enters the toilet in two paths, and the functions of the two paths are different. One path of tap water enters the toilet through water injection holes in the periphery of the hollow frame (41) and plays a role in flushing the inner wall of the toilet, and the tap water is easily mixed with residues of excrement and urine as well as sealing water but cannot be canceled. The other path of tap water enters the toilet through the basin bottom water injection hole (43) and plays a role in sending the residues of excrement and urine as well as sealing water to the propeller (411) with the minimum mixing. Reasonable distribution of the two paths of tap water, namely clear water, is a key for fully saving water.

The pipe cavity (419) attached to the outer wall of the toilet between the hollow frame water inlet (42) and the basin bottom water injection hole (43) communicates with the bottom of the basin, the liquid levels on the two sides of a connecting vessel are always flush, and in the process of defecation or urination of a person, the mixture of excrement and urine as well as sealing water can enter the pipe cavity (419) at any time to pollute the pipe cavity (419). The pipe cavity (419) cannot be cleaned, and water scale cannot be removed. In order to eliminate the defect, the basin bottom water injection valve (415) is arranged at the basin bottom water injection hole (43), the pedal valve handle (416), the valve line a (417) and the valve line b (418) are utilized, the valve line a (417) is connected with the tap water supply valve (64), the valve line b (418) is connected with the basin bottom water injection valve (415), when the pedal valve handle (416) is treaded, under the traction of the valve line a (417) and the valve line b (418), the tap water supply valve (64) and the basin bottom water injection valve (415) are opened at the same time. Therefore, the tap water supply valve (64) and the basin bottom water injection valve (415) can be synchronously controlled, namely, the work of the water turbine is synchronous with the opening of the basin bottom water injection valve (415), and the stop of the water turbine is also synchronous with the closing of the basin bottom water injection valve (415). Therefore, the basin bottom water injection valve (415) plays two roles: firstly, the mixture of excrement and urine as well as sealing water is prevented from entering the pipe cavity (419), so that the pipe cavity (419) is not polluted and free of water scale; and secondly, after the toilet is flushed each time, the pipe cavity (419) is always filled with clear water, and the clear water is reserved for being used for flushing the toilet next time, so that the time difference between the pumping of the mixture of excrement and urine as well as the sealing water and the following up of the clear water described at present is avoided, and a satisfactory sequential following up effect is formed.

Figure 6:
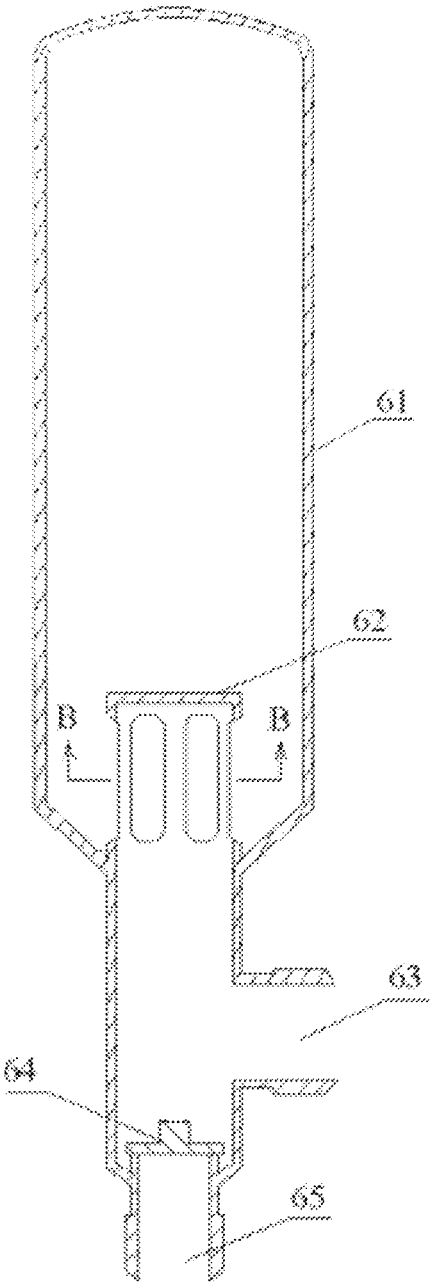
FIG. 6 is a front section view of a pressure energy relay device in the present disclosure.

More preferably, as the pressure of tap water is reduced along with the rise of floor of a building, in order to fully improve the utilization efficiency of tap water energy, a pressure energy relay device is arranged at the joint of the tap water pipe network and the water turbine in the present disclosure. As shown in FIG. 6, the pressure energy relay device comprises a pressure tank (61), a water mask (62) and a tap water pipe network connector (63); the pressure tank (61) is connected between the tap water pipe network connector (63) and the tap water supply valve (64); and the tap water pipe network connector (63) is connected with the tap water pipe network, and a valve body water outlet (65) of the tap water supply valve (64) is connected with the tap water inlet (13, 23, 49) of the water turbine. The pressure tank (61) is a vertical tank body with a closed top and an open bottom. The water mask (62) is a small cylinder with a closed upper part and a side wall windowed towards the periphery, an opening in the lower part of the water mask (62) communicates with the bottom inlet of the pressure tank (61), and the water mask (62) is arranged at an inlet below the pressure tank (61), as shown in FIG. 6. During working, the tap water supply valve (64) is closed, tap water continuously rushes into the pressure tank (61) through the tap water pipe network connector (63), and air in the pressure tank is compressed upwards until the pressure of compressed air above the pressure tank (61) is equal to that of the tap water. At this time, a large amount of energy is stored in the pressure tank (61), so that the water turbine has two energy sources at the same time: one energy source is directly from the tap water pipe network, and the other energy source is from the pressure tank (61). The two energy sources have respective characteristics: the pipeline of the tap water pipe network is long, the whole tap water pipe network can be dragged by the flowing out of tap water, water supply resistance exists, and the resistance does not exist in the pressure tank. When the tap water supply valve (64) is opened, the two energy sources are complemented side by side, water is supplied to the water turbine at the same time, unexpected effects can be generated, and the power of the water turbine is multiplied.

Figure 7:
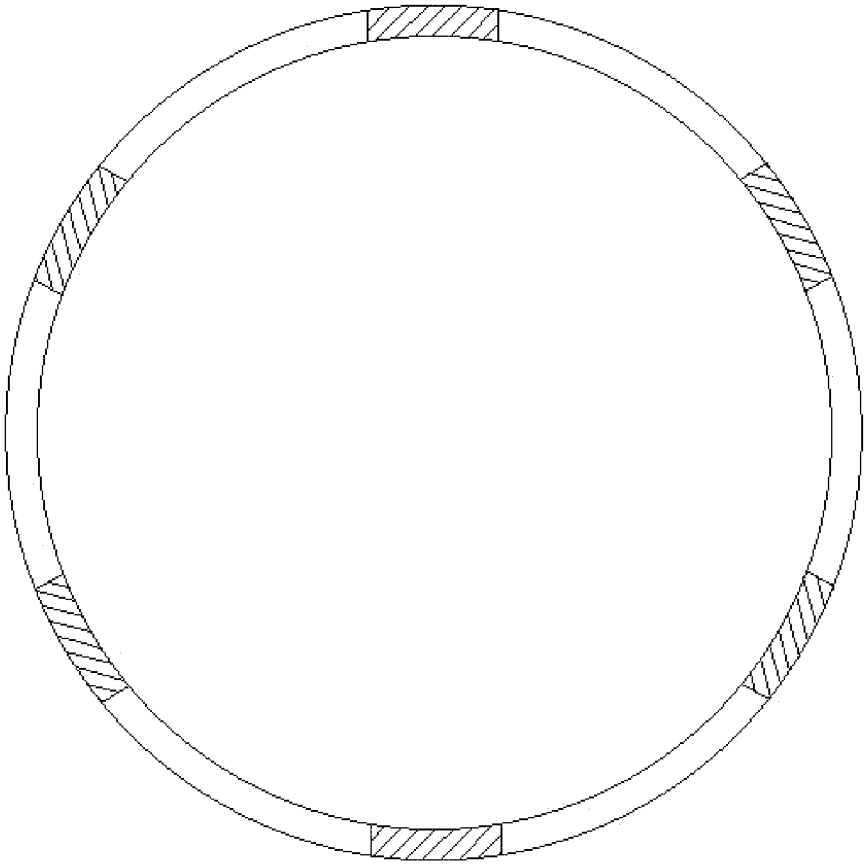
FIG. 7 is a section view of a water mask in a pressure energy relay device along a section line B-B in the present disclosure.

The pressure energy relay device uses compressed air to store energy, as shown in FIG. 6 and FIG. 7, and the water mask (62) is arranged at the inlet of the pressure tank (61)

to prevent a water column from rushing out of the water surface and returning to the water to bring the air into the water, causing a large number of bubbles in the water during water inflow, and if water inflow and water drainage occur continuously and alternately, the bubbles cannot rise out of the water surface in time and are discharged along with the water flow. Then the air in the pressure tank (61) is less and less, and the energy storage effect of the pressure tank (61) is worse and worse.

In addition, as shown in FIG. 4, in the water turbine structure of the water turbine power suction type toilet, the arrangement of the funnel plugging body (414) is also necessary. Because the upstream pipeline above the propeller (411) is very short, and when the propeller (411) rotates, the water in the upstream pipeline above the propeller (411) forms a funnel surface due to rotation. The downward exploring depth of the conical tip of the funnel surface is related to the feeding speed of the fluid below the propeller (411), the slower the feeding speed is, the longer the time of the water acted by the propeller when passing through the propeller, the higher the rotating speed is, and the deeper the downward exploring depth of the conical tip of the funnel surface is. A discharge amount of excrement of young people is relatively large, the S-shaped bend inlet is fully filled, the feeding resistance of the fluid below the propeller (411) is abnormally large when the toilet is flushed, the conical tip of the funnel surface of the upstream pipeline above the propeller penetrates through the propeller (411) due to excessive downward exploring, negative pressure below the propeller does not exist any more, and therefore the suction force is completely lost. In order to avoid the above situation, it is possible to arrange a funnel plugging body (33, 414) at the place where the funnel surface appears. The funnel plugging body (33, 414) is a slightly tapered circular sleeve with a larger upper part, a smaller lower part and a bottom at the lower part, and three to four strip-shaped rubber fins (34) are uniformly distributed along a periphery of the funnel plugging body (33, 414) at a position of an upper part of a circular sleeve of the funnel plugging body (33, 414) right facing the S-shaped bend horizontal overflow port section (46). The lower part of the funnel plugging body (33, 414) and the propeller (32, 411) are combined to form a whole and rotate together. The funnel plugging body (33, 414) has three functions at the same time: firstly, the negative pressure below the propeller (411) is maintained; secondly, winding of fibrous excrement residues is avoided; in recent years, food materials are put into a hot pot without cutting off the whole plants, and long food residues can appear in excrement; although the propeller (411) has a cutting effect, this kind of residues may get over the propeller (411) to be wound on the water turbine shaft above the propeller (411); and after the funnel plugging body (33, 414) is arranged, this part becomes thick, and this kind of residues cannot be wound on this part any more; and thirdly, the rubber fins (34) positioned at the upper part of the funnel plugging body (33, 414) can increase the centrifugal force of the mixture of excrement and urine as well as sealing water reaching the S-shaped bend horizontal overflow port section (46), and the mixture can be thrown into the kettle belly accommodating body (47) as soon as possible.

Figure 8:
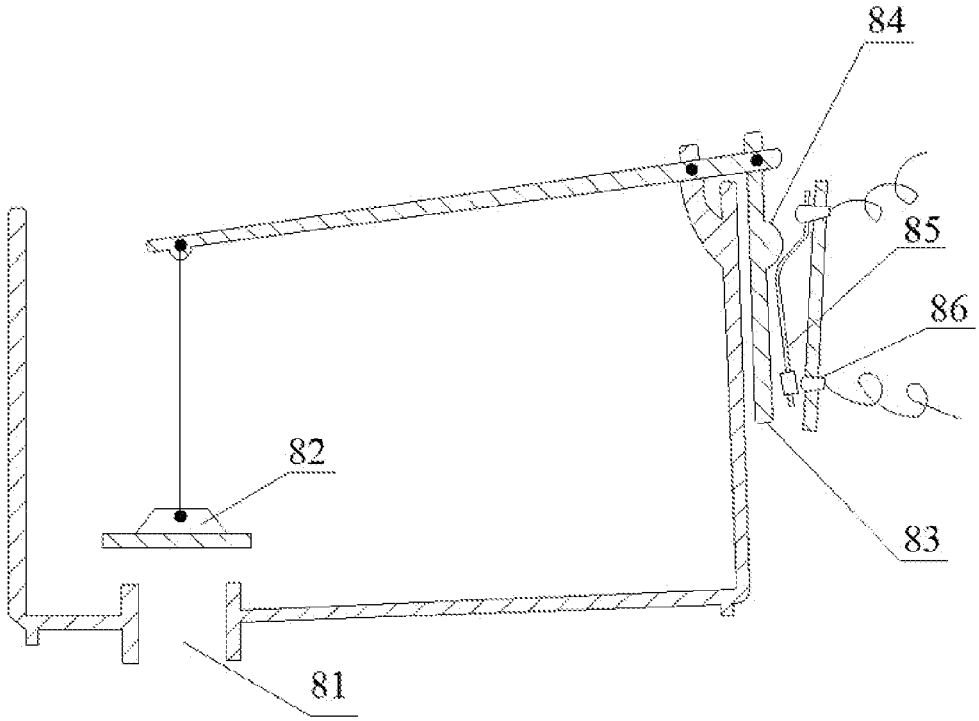
FIG. 8 is a front section view of a water tank in the present disclosure.

In order to improve the universality of the water-saving toilet, the water-saving toilet is suitable for the situation that the tap water pressure is insufficient, the present disclosure also provides a suction type water-saving toilet with an electric motor as power, and the electric motor replaces a water turbine to serve as a suction power source. The power suction type toilet disclosed by the present disclosure can save a large amount of water, the key is in that the suction of the water turbine or the electric motor is utilized to force excrement liquid to run in advance and clear water to follow the excrement liquid, and the excrement liquid and the clear water leave the toilet in sequence and fall into a sewer, so that the mixing of the clear water and the excrement liquid is reduced to the maximum extent. Under a condition that the pressure of tap water is not smaller than 0.35 MPa, the water turbine can be preferentially used as power. As shown in FIG. 1 and FIG. 4, the water turbine is hermetically installed at the upper port of the S-shaped bend kettle belly accommodating body (47) through an assembling thread (111) and an assembling rubber gasket (112). The tap water inlet (49) is connected with the valve body water outlet (65) of the tap water pressure energy relay device through a hose. The volute chamber water outlet (410) of the water turbine is connected with the hollow frame water inlet (42) through a hose. The tap water supply valve (64) used here is actually a pedal valve widely used in public toilets at present, the pedal valve is used by removing the valve handle thereof and moving to the lower part in the front of the toilet, which is the pedal valve handle (416) as shown in FIG. 4. The valve handle is connected to the valve line a (417) of the tap water supply valve (64) and the valve line b (418) of the basin bottom water injection valve (415), and a brake line of a bicycle line brake can be adopted. When the pedal valve handle (416) is treaded, the tap water supply valve (64) and the basin bottom water injection valve (415) are opened, and when tap water, namely clear water, passes through the water turbine and reaches the S-shaped bend inlet section (44) from the water injection holes in the periphery of the hollow frame (41) and the basin bottom water injection hole (43), original excrement liquid is almost completely pumped away by the water turbine, so that large-scale mixing of the clear water and the excrement liquid is avoided. Experiments prove that if the pressure of tap water is smaller than 0.35 MPa (or a certain value, the pressure of tap water is insufficient), the electric motor can be used as power, and switching needs to be carried out as follows: the water tank is placed at the position where the machine cabin cover of the water turbine is originally placed, and the electric motor is hermetically installed at the upper port of the S-shaped bend kettle belly accommodating body (47) through the assembling thread (111) and the assembling rubber gasket (112). The propeller is arranged at the lower end of the electric motor rotating shaft (18, 31, 413). The water tank is shown in FIG. 8, the other end of a hose connected with the water inlet (42) of the hollow frame is changed to be connected to a water outlet (81) of the water tank, the valve line a (417) is changed to be connected to the lower end of the transmission rod (83) through the tap water supply valve (64), the valve line b (48) is still connected with the basin bottom water injection valve (415), and the two ends of a switch wire of the electric motor are connected with a moving contact (85) and a static contact (86) of an electric motor switch respectively. When the pedal valve handle (416) is treaded, the transmission rod (83) is pulled downwards, the plastic protruding part (84) pushes the moving contact (85) of the electric motor switch to the static contact (86), the electric motor is connected, and meanwhile the water drain valve (82) of the water tank and the basin bottom water injection valve (415) are opened at the same time. Because the speed of current is far higher than the flowing speed of water, when tap water, namely clear water, reaches the S-shaped bend inlet from the water injection holes in the periphery of the hollow frame (41) and the basin bottom water injection hole (43), the original excrement liquid is almost completely pumped away. The effect is the same as that produced by the water turbine.

The water tank is involved when the electric motor is used as power, and as the water consumption of the novel toilet for cleaning each time is only about one fourth of that of a traditional toilet, the water tank can be made into an exquisite and attractive plastic product, which is low in height and is placed at the position of the machine cabin cover, just like a thickened machine cabin cover. The pressure relay energy device does not need to be connected between the water tank and the tap water pipe network, and the connection between the water tank and the tap water pipe network as well as control of water inflow is the same as the traditional toilet, which is not shown here.

The valve handle of the basin bottom water injection valve (415) is located outside the water system, sealing between the valve body and the valve handle is a corrugated pipe made of high-quality silica gel, one end of the corrugated pipe is sleeved on a valve shell opening extending out of the valve handle in a sealed mode, the other end of the corrugated pipe is sleeved on the valve handle in a sealed mode, the corrugated pipe can stretch out and draw back freely like a spring, and the high-quality silica gel can not be damaged for a long time, so that the valve handle can be freely drawn without leakage for a long time.

According to the water turbine and electric motor hybrid power suction type toilet, the working process of the water turbine or the electric motor is divided into two stages. In the first stage, the amount of the mixture of excrement and urine as well as sealing water, namely excrement liquid, is large, and the S-shaped bend inlet is deeply buried below the liquid level, so that the power of the water turbine or the electric motor is fully exerted. Under the condition that the pedal valve handle (416) is treaded, the excrement liquid is almost completely pumped away instantly, and at the moment, clear water injected from the water injection holes in the periphery of the hollow frame (41) and the basin bottom water injection hole (43) does not reach the position of the S-shaped bend inlet. In this stage, large-scale mixing of clear water and excrement liquid is avoided unsurprisingly. However, in the first stage, the excrement liquid cannot be completely pumped away, because the pumping function of the propeller is achieved through atmospheric pressure, when the liquid level of the excrement liquid drops below the upper opening edge of the S-shaped bend inlet, air enters immediately, negative pressure below the propeller does not exist any more, and the pumping function disappears immediately. At this time, the depth of the residual excrement liquid is not enough to bury the S-shaped bend inlet. In the first stage, although large-scale mixing of the clear water and the excrement liquid is avoided, sufficient conditions are provided for small-scale mixing of the clear water and the residual excrement liquid in the second stage. In the second stage, the suction function of the water turbine or the electric motor can be recovered after the water level rises and the S-shaped bend inlet is buried again due to injection of clear water, the power of the water turbine or the electric motor cannot be fully exerted in the stage, and the water turbine or the electric motor can pump away the clear water every time when the clear water is injected. Clear water injected from the periphery of the hollow frame cannot reach the position of the S-bend inlet at the same time, and the flowing direction at the time of arrival is very inconsistent with the flowing direction caused here due to the suction of the water turbine or the electric motor, the injected clear water is very easy to mix with residual excrement liquid, and if no measure is taken, the residual excrement liquid is diluted by continuously injected clean water, the diluted excrement liquid is continuously pumped away, if the finally remaining sealing water becomes clear water, a large amount of clear water needs to be injected, and water waste caused by this small-scale mixing is also considerable. The hollow frame water inlet (42) does not communicate with the hollow frame (41) at the rear part of the toilet directly, so that the water injection mode of the hollow frame into the toilet is improved. The above is the situation before the basin bottom water injection valve (415) and the flow rectifying device (412) are arranged. The small-scale mixing in the second stage can be truly and thoroughly reduced, and the basin bottom water injection valve (415) and the flow rectifying device (412) play a key role. Due to the existence of the basin bottom water injection valve (415), after the toilet is cleaned each time, the pipe cavity (419) is always filled with clear water, the clear water can be reserved for being used for cleaning the toilet next time, and the pipe cavity (419) can be selected to be relatively thick and large, so that more clear water can be contained. The flow rectifying device (412) can adopt a fixed propeller impeller or a spherical circular baffle with densely distributed small holes, and the convex surface of the spherical surface is outwards similar to a shower head used during showering and plays a role in decelerating and expanding the water flow. At the end of the first stage of the operation of the water turbine or the electric motor for cleaning the toilet next time, clear water injected from the basin bottom water injection hole (43) can rush out first due to the fact that the clear water is stored in the pipe cavity after cleaning the toilet last time, and under the action of the flow rectifying device (412), the clear water is spread to fill the channel leading to the S-shaped bend inlet, and residual excrement liquid located in the front is pushed forwards; and before clear water injected from the water injection holes in the periphery of the hollow frame arrives, the residual excrement liquid is completely sent into the S-shaped bend inlet, so that the small-scale mixing is reduced to the maximum extent.

The basin bottom water injection valve (415) further has the function of keeping the pipe cavity (419) clean, if the basin bottom water injection valve (415) is not available, the pipe cavity (419) communicates with the bottom of the basin, the liquid levels on the two sides are always kept flush, in the process of defecation of people, excrement liquid can continuously enter the pipe cavity (419), and particularly when the traditional toilet is blocked, the depth of the excrement liquid in the toilet is the depth of the excrement liquid in the pipe cavity (419). Pollutants on the tube cavity (419) cannot be cleaned, and water scale cannot be removed. This toilet is provided with the basin bottom water injection valve (415) which is opened only when clear water is injected into the toilet from the pipe cavity (419) in the toilet cleaning process, and the basin bottom water injection valve (415) is kept closed at other times, so that neither pollution nor scaling can occur. In addition, the flow rectifying device (412) may be configured to fix in place through a friction force, only this position can be polluted, and therefore the rectifying device (412) is configured to be movable and easy to disassemble, and may be very easily take off every half a year or one year to be cleaned and then installed back, and the scaling is avoided.

The present disclosure relates to a water turbine and electric motor hybrid power suction type toilet which is superior to a traditional toilet, and the key point is that the novel toilet thoroughly changes the long and zigzag structure of an S-shaped bend pipeline of the traditional toilet.

In order to facilitate excrement to pass through the S-shaped bend, the S-shaped bend propeller position section (45) can be specially made into a conical pipe with a large upper part and a small lower part.

The S-shaped bend horizontal overflow port section (46) is an inclined circular pipe, where half of the inclined circular pipe is cut into a horizontal overflow port (51), the S-shaped bend horizontal overflow port section (46) is used for retaining the sealing water, and the position of the horizontal overflow port (51) is a position of the highest water level of the sealing water. However, the S-shaped bend horizontal overflow port section (46) does not only retain the sealing water, and due to the existence of the S-shaped bend horizontal overflow port section (46), the horizontal overflow port (51), the flow deflector (52), the strip-shaped rubber fins (34) and the S-shaped bend kettle belly accommodating body (47) jointly form a perfect combination. The perfect combination has the effects that as long as the fluid crosses the S-shaped bend propeller position section (45), the fluid is thrown into the S-shaped bend kettle belly accommodating body (47) along the flow deflector (52) without being left under the driving of the strip-shaped rubber fins (34), and then automatically falls into the sewer through the S-shaped bend connecting sewer pipe network section (48). Therefore, the toilet can be cleaned only by sending the residual excrement liquid to the S-shaped bend propeller position section (45) by the clear water along with the residual excrement liquid in the second stage of the operation of the water turbine or the electric motor. The length of the propeller position section (45) is less than 4 cm, and the funnel plugging body (33, 414) occupies a considerable position, so that the process can be completed by only needing a small amount of clear water to follow the residual excrement liquid. Therefore, the whole cleaning process is very water-saving.

The strip-shaped rubber fins (34) play a role in accelerating the rotation of the fluid to obtain larger centrifugal force, but do not require the fluid to rotate synchronously with the water turbine or the electric motor. Therefore, compared with blades in the same shape and made of hard materials, the rubber fins (34) have a soft interaction with the fluid, and the noise is low.

The S-shaped bend kettle belly accommodating body (47) also plays another important role. In the first stage of operation of the water turbine or the electric motor, a large amount of excrement liquid is instantaneously pumped away, so that the excrement liquid cannot be discharged by the rear pipeline in time, but the excrement liquid can be instantaneously and completely received by the S-shaped bend kettle belly accommodating body (47) with a larger inner diameter and then slowly discharged into the sewer from the rear pipeline.

In addition, as shown in FIG. 4, the arrangement of the funnel plugging body is also necessary in the water turbine and electric motor power suction type toilet of the present disclosure. Because the upstream pipeline above the propeller (411) is very short, and when the propeller (411) rotates, the water in the upstream pipeline above the propeller (411) forms a funnel surface due to rotation. The downward exploring depth of the conical tip of the funnel surface is related to the feeding speed of the fluid below the propeller (411), the slower the feeding speed is, the longer the time of the water acted by the propeller when passing through the propeller, and the higher the rotating speed is, the deeper the downward exploring depth of the conical tip of the funnel surface is. A discharge amount of excrement of young people is relatively large, the S-shaped bend inlet is fully filled with large excrement discharge amount of young people, the feeding resistance of the fluid below the propeller (411) is abnormally large when the toilet is flushed, the feeding is very slow, the conical tip of the funnel surface of the upstream pipeline above the propeller penetrates through the propeller (411) due to excessive downward exploring, negative pressure below the propeller does not exist any more, and therefore the suction force is completely lost. In order to avoid the above situation, it is possible to arrange a funnel plugging body (33, 414) at the place where the funnel surface appears. The funnel plugging body (33, 414) is a slightly tapered circular sleeve with a larger upper part, a smaller lower part and a bottom at the lower part, and three to four strip-shaped rubber fins (34) are uniformly distributed along a periphery of the funnel plugging body (33, 414) at a position of an upper part of a circular sleeve of the funnel plugging body (33, 414) right facing the S-shaped bend horizontal overflow port section (46). The lower part of the funnel plugging body (33, 414) and the propeller (32, 411) are combined to form a whole and rotate together. The funnel plugging body (33, 414) has three functions at the same time: firstly, the forming position of the funnel surface is occupied, and the negative pressure below the propeller (411) is maintained; secondly, winding of fibrous excrement residues is avoided; in recent years, food materials are put into a hot pot without cutting off the whole plants, and long food residues can appear in excrement; although the propeller (411) has a cutting effect, this kind of residues may get over the propeller (411) to be wound on the water turbine shaft above the propeller (411); and after the funnel plugging body (33, 414) is arranged, this part becomes thick, and this kind of residues cannot be wound on this part any more; and thirdly, the rubber fins (34) positioned at the upper part of the funnel plugging body (33, 414) can increase the centrifugal force of the mixture of excrement and urine as well as sealing water reaching the S-shaped bend horizontal overflow port section (46), and the mixture can be thrown into the kettle belly accommodating body (47) as soon as possible.

The water turbine and electric motor hybrid power suction type toilet is superior to the traditional toilet since the defect that the S-shaped bend pipeline of the traditional toilet is long, zigzag and unopenable is thoroughly overcome. The water turbine and electric motor hybrid power suction type toilet has the advantages that when the toilet is cleaned, excrement and urine are mixed to reach the propeller (411) together with sealing water and undergo a continuous process of smashing, diluting and propelling, and then the mixture is thrown into the kettle belly accommodating body (47) and automatically falls into the sewer through the S-shaped bend connecting sewer pipe network section (48). Intact excrement is present only in the S-shaped bend inlet section (44), so that blocking becomes impossible. The installation position of the water turbine or the electric motor becomes an openable position of the S-shaped bend, and water scale can be thoroughly removed. The propeller position section (45), the horizontal overflow port section (46) and the kettle belly accommodating body (47) can be made of melamine plastic as a whole to be manufactured separately, and the ceramic main body part of the toilet can be used permanently.

More preferably, according to the water turbine and electric motor hybrid power suction type toilet, when the water turbine is used as power, in order to fully improve the utilization efficiency of tap water energy, a pressure energy relay device is arranged at the joint of the tap water pipe network and the water turbine. As shown in FIG. 6, the pressure energy relay device comprises a pressure tank (61), a water mask (62) and a tap water pipe network connector (63); the pressure tank (61) is connected between the tap water pipe network connector (63) and the tap water supply valve (64); and the tap water pipe network connector (63) is connected with the tap water pipe network, and a valve body water outlet (65) of the tap water supply valve (64) is connected with the tap water inlet (13, 23, 49) of the water turbine. The pressure tank (61) is a vertical tank body with a closed top and an open bottom. The water mask (62) is a small cylinder with a closed upper part and a side wall windowed towards the periphery, an opening in the lower part of the water mask (62) communicates with the bottom inlet of the pressure tank (61), and the water mask (62) is arranged at an inlet below the pressure tank (61), as shown in FIG. 6. The tap water supply valve (64) is closed, tap water continuously rushes into the pressure tank (61) through the tap water pipe network connector (63), and air in the pressure tank is compressed upwards until the pressure of compressed air above the pressure tank (61) is equal to that of the tap water. At this time, a large amount of energy is stored in the pressure tank (61), so that the water turbine has two energy sources at the same time: one energy source is directly from the tap water pipe network, and the other energy source is from the pressure tank (61). The two energy sources have respective characteristics: the pipeline of the tap water pipe network is long, the whole tap water pipe network can be dragged by the flowing out of tap water, water supply resistance exists, and the resistance does not exist in the pressure tank. When the tap water supply valve (64) is opened, the two energy sources are complemented side by side, water is supplied to the water turbine at the same time, unexpected effects can be generated, and the power of the water turbine is multiplied. At the same time, when the tap water supply valve (64) is closed suddenly, unnecessary impact can be reduced.

According to the pressure energy relay device, as shown in FIG. 6 and FIG. 7, the water mask (62) is arranged at the inlet of the pressure tank (61), and the pressure energy relay device aims to prevent a water column from rushing out of the water surface and returning to the water, air above the tank body is brought into the water, a large number of bubbles appear in the water, and if water inflow and water drainage occur continuously and alternately, the bubbles cannot rise out of the water surface in time and are discharged along with the water flow. The air in the pressure tank (61) is less and less, and the energy storage effect of the pressure tank (61) is worse and worse.

The present disclosure is not limited to the embodiment, and any modification or alternative to the basic spirit of the embodiment still fall within the scope of the present disclosure as claimed in the claims.

The present disclosure adopts the following technical schemes:

A power suction type toilet, wherein a toilet main body of the toilet comprises a hollow frame (41), a hollow frame water inlet (42), a basin bottom water injection hole (43) and an S-shaped bend, wherein the hollow frame (41) is located on the upper part of the toilet, and water injection holes are distributed in the hollow frame (41) along the periphery towards the inner side of the toilet; the hollow frame water inlet (42) is formed in the rear part of the toilet; the basin bottom water injection hole (43) is formed in the lower part of the toilet and communicates with the hollow frame water inlet (42) through a pipe cavity (419) attached to the outer wall of the toilet, and the S-shaped bend is located at the lower part of the toilet; and a basin bottom water injection valve (415) is further arranged at an opening, leading to the S-shaped bend, of the basin bottom water injection hole (43) and controls connection and disconnection of the basin bottom water injection hole (43) and an S-shaped bend inlet section (44) with the water pumping process of the toilet synchronously.

wherein the hollow frame water inlet (42) does not communicate with the hollow frame (41) at the rear part of the toilet directly, but is connected with the pipe cavity (419) attached to the outer wall of the toilet, extends to a certain position from back to front along two sides of the toilet in a bilateral symmetry manner and then is divided into two paths respectively led upwards to the hollow frame (41) and led downwards to the basin bottom water injection hole (43).

wherein a flow rectifying device (412) is further arranged at the opening of the basin bottom water injection hole (43), the basin bottom water injection valve (415) and the flow rectifying device (412) are sequentially arranged from inside to outside relative to the pipe cavity (419), and the flow rectifying device (412) is used for diffusing water flowing out of the basin bottom water injection valve (415).

wherein the flow rectifying device (412) is a fixed propeller.

wherein the flow rectifying device (412) is a spherical circular baffle with densely distributed small holes, and the convex surface of the spherical surface is outward and is similar to a shower head.

wherein the S-shaped bend is divided into an S-shaped bend inlet section (44), an S-shaped bend propeller position section (45), an S-shaped bend horizontal overflow port section (46), an S-shaped bend kettle belly accommodating body (47) and an S-shaped bend connecting sewer pipe network section (48).

wherein the S-shaped bend propeller position section (45) is a conical pipe with a large upper part and a small lower part; the S-shaped bend horizontal overflow port section (46) is an inclined circular pipe with one half cut into a horizontal overflow port, the cut half is cut to form a horizontal overflow port (51), and the non-cut half forms a flow deflector (52); the upper end and the lower end of the S-shaped bend kettle belly accommodating body (47) are connected with the upper end and the lower end of the S-shaped bend horizontal overflow port section (46) respectively, the inner diameter of the S-shaped bend kettle belly accommodating body (47) is larger than the outer diameter of the S-shaped bend horizontal overflow port section (46), a cavity is formed between the S-shaped bend kettle belly accommodating body (47) and the S-shaped bend horizontal overflow port section (46), the cavity communicates with the S-shaped bend propeller position section (45) through the horizontal overflow port (51), and meanwhile, communicates with the S-shaped bend connecting sewer pipe network section (48).

wherein a component for mounting or dismounting a power mechanism is arranged at an upper port of the S-shaped bend kettle belly accommodating body (47), so that the upper port becomes an openable part of the S-shaped bend.

wherein the component is an assembling internal thread.

wherein the power mechanism is a water turbine or an electric motor.

wherein an electric motor and a water tank are arranged at the upper part of an S-shaped bend kettle belly accommodating body (47) located at the rear part of the toilet, a machine cabin for accommodating the electric motor is arranged, and the water tank is arranged in the machine cabin or outside the machine cabin.

wherein the water tank is set as a machine cabin cover for accommodating the machine cabin of the electric motor and arranged at the upper part of the machine cabin of the electric motor.

wherein a water outlet (81) is formed in the bottom of the water tank, a water drain valve (82) is arranged above the water outlet (81), a transmission rod (83) capable of lifting the water drain valve (82) through a lever device is arranged on the outer side of the rear part of the water tank, a protruding part (84) is arranged on the transmission rod (83), a moving contact (85) and a static contact (86) of an electric motor switch are arranged near the protruding part (84), and when the transmission rod (83) is pulled to lift the water drain valve (82), the protruding part (84) pushes the moving contact (85) of the electric motor switch to the static contact (86), so that the moving contact (85) and the static contact (86) are electrically connected, and the switch is switched on; an electric motor rotating shaft (18, 31, 413) extends into the lower end of the S-shaped bend; and a propeller (32, 411) is arranged at the lower end of the electric motor rotating shaft (18, 31, 413) in the S-shaped bend.

wherein the toilet also comprises a control valve handle (416) to realize synchronous control of the electric motor, the water drain valve (82) and the basin bottom water injection valve (415).

wherein the control valve handle (416) is a pedal valve handle arranged at the lower part in front of the toilet main body, and a valve line a (417) and a valve line b (418) extend out of the control valve handle (416) at the same time; the valve line a (417) is connected with the lower end of the transmission rod (83), the valve line b (418) is still connected with the basin bottom water injection valve (415), and the control valve handle (416) synchronously controls the electric motor, the water drain valve (82) and the basin bottom water injection valve (415).

wherein the control valve handle (416) is controlled by an electric button.

wherein the propeller (32, 411) installed on the lower part of the electric motor rotating shaft (18, 31, 413) is located at the S-shaped bend propeller position section (45), and a cutting edge is arranged on the front part of the blade of the propeller (32, 411).

wherein the electric motor rotating shaft (18, 31, 413) is further provided with a funnel plugging body (33, 414); the funnel plugging body (33, 414) is a circular sleeve with a slightly tapered lower part, upper part larger and lower part smaller, and with a bottom at the lower part, and the funnel plugging body (33, 414) and the propeller (32, 411) are sequentially installed on the impeller rotating shaft (18, 31, 413) from top to bottom; and the lower part of the funnel plugging body (33, 414) is combined with the propeller (32, 411), and the funnel plugging body (33, 414) and the propeller (32, 411) are integrated and rotate synchronously.

wherein an assembling external thread (111) matched with an assembling internal thread at the upper port of the S-shaped bend kettle belly accommodating body (47) and a rubber gasket (112) are arranged on the end face of the electric motor body extending out the rotating shaft.

wherein a sealing device is arranged at the joint of the electric motor rotating shaft (18, 31, 413) and the electric motor body preventing water from entering the electric motor.

wherein the electric motor is hermetically installed at an upper port of the S-shaped bend kettle belly accommodating body (47) through the assembling external thread (111) and the rubber gasket (112), and the electric motor rotating shaft (18, 31, 413) extends into the lower end of the S-shaped bend.

wherein a water turbine is arranged at the upper part of the S-shaped bend kettle belly accommodating body (47) located at the rear part of the toilet, and a machine cabin for accommodating the water turbine is arranged.

wherein a shell of the water turbine comprises a volute chamber (11, 21) for accommodating an impeller and a shaft retaining body (12) for supporting an impeller rotating shaft (18, 31, 413), and the volute chamber (11, 21) and the shaft retaining body (12) are fixed into a whole; the impeller comprises an impeller chassis (15), a blade (17, 22) and a blade upper cover (16) which are fixed into a whole; the impeller rotating shaft (18, 31, 413) is fixed on the impeller chassis (15), the upper part of the impeller rotating shaft (18, 31, 413) extends into a shaft hole of the shaft retaining body (12), and the lower part of the impeller rotating shaft (18, 31, 413) extends into the lower end of the S-shaped bend through the volute chamber (11, 21) of the water turbine; the impeller rotating shaft (18, 31, 413) is provided with the propeller (32, 411) located at the lower end of the S-shaped bend; a tap water inlet (13, 23, 49) is formed in the side wall tangential to the volute chamber (11, 21); the tap water inlet (13, 23, 49) is connected with a tap water pipe network; a volute chamber water outlet (14, 410) is formed in one side of the upper part of the volute chamber (11, 21) from the shaft retaining body (12); and the volute chamber water outlet (14, 410) of the water turbine is connected with the hollow frame water inlet (42) of the toilet.

wherein the toilet also comprises a control valve handle (416) to realize synchronous control on a tap water supply valve (64) and the basin bottom water injection valve (415).

wherein the control valve handle (416) is a pedal valve handle arranged on the lower part in front of the toilet main body, and a valve line a (417) and a valve line b (418) extend out of the control valve handle (416) at the same time; the valve line a (417) is connected with the tap water supply valve (64), the valve line b (418) is connected with the basin bottom water injection valve (415), and the control valve handle (416) synchronously controls the tap water supply valve (64) and the basin bottom water injection valve (415).

wherein the control valve handle (416) is controlled by an electric button.

wherein the propeller (32, 411) installed on the lower part of the impeller rotating shaft (18, 31, 413) is located on the S-shaped bend propeller position section (45), and a cutting edge is arranged on the front part of the blade of the propeller (32, 411).

wherein the impeller rotating shaft (18, 31, 413) is further provided with a funnel plugging body (33, 414); the funnel plugging body (33, 414) is a circular sleeve with a slightly tapered lower part, upper part larger and lower part smaller, and with a bottom at the lower part, and the funnel plugging body (33, 414) and the propeller (32, 411) are sequentially installed on the impeller rotating shaft (18, 31, 413) from top to bottom; and the lower part of the funnel plugging body (33, 414) is connected with the propeller (32, 411), and the funnel plugging body (33, 414) and the propeller (32, 411) are integrated and rotate synchronously.

wherein three to four strip-shaped rubber fins (34) are uniformly distributed on the periphery of the position, right opposite the S-shaped bend horizontal overflow port section (46), of the upper part of the circular sleeve of the funnel plugging body (33, 414), the upper part of the rubber fin (34) straightly follows the circular sleeve, and the lower part of the rubber fin (34) is bent around the circular sleeve towards one side with the same upward propelling effect as the propeller.

wherein the lower part of the volute chamber (11, 21) is provided with an assembling external thread (111) matched with an assembling internal thread at the upper port of the S-shaped bend kettle belly accommodating body (47) and an assembling rubber gasket (112).

wherein a capping screw head (19) and a sealing rubber pad (110) are arranged at the upper end of a shaft hole for supporting an impeller rotating shaft (18, 31, 413) in the shaft retaining body (12); and the shaft retaining body (12) is used for axially positioning the impeller rotating shaft (18, 31, 413) and sealing the shaft hole of the impeller rotating shaft (18, 31, 413) through the capping screw head (19) and the sealing rubber pad (110).

wherein the blade (17, 22) is a curved surface of which the generatrix is perpendicular to the impeller chassis (15); and the blade upper cover (16) is a conical surface, so that the height of a water passage formed by the adjacent blades is gradually increased from outside to inside.

wherein a pressure energy relay device is further installed at the joint of the tap water pipe network and the tap water inlet (13, 23, 49) of the water turbine.

wherein the pressure energy relay device comprises a pressure tank (61) and a tap water pipe network connector (63); the pressure tank (61) is a vertical tank body with a closed top and an open bottom, and is connected between the tap water pipe network connector (63) and the tap water supply valve (64) through the bottom opening of the pressure tank (61); and the tap water pipe network connector (63) is connected with the tap water pipe network, and a valve body water outlet (65) of the tap water supply valve (64) is connected with the tap water inlet (13, 23, 49) of the water turbine.

wherein the pressure energy relay device also comprises a water mask (62) arranged at the inlet below the pressure tank (61), the water mask (62) is a small cylinder with a closed upper part and a side wall windowed towards the periphery, and the opening in the lower part of the water mask (62) communicates with the inlet of the pressure tank (61).

A power suction method of a power suction type toilet applied to the above water turbine and electric motor hybrid power suction type water-saving toilet, wherein an electric motor is used as power, the electric motor and a water tank drain valve (82) are started at the same time, due to the fact that the speed of current is larger than that of water flow, the electric motor drives a propeller (32, 411) to pump away a mixture of excrement and urine at the plugging position of an S-shaped bend and sealing water in advance, and then clear water injected through water injection holes of a hollow frame and a basin bottom water injection hole (43) of the toilet arrives, so that the effect that the mixture of excrement and urine as well as sealing water continuously pumped out in front and clear water continuously and sequentially followed is achieved at the position of the S-shaped bend.

A power suction method of a power suction type toilet applied to the above water turbine and electric motor hybrid power suction type water-saving toilet, wherein a water turbine is used as power, a tap water supply valve (64) is opened, tap water enters a volute chamber (11, 21) of the water turbine from a tap water inlet (13, 23, 49) to drive the water turbine, and the water turbine drives a propeller (32, 411) to pump the mixture of excrement and urine as well as sealing water at an inlet of the S-shaped bend into a sewer; wherein tap water firstly flows through the water turbine to transfer energy to the impeller and then enters the basin through the water injection holes in the hollow frame and the basin bottom water injection hole (43) of the toilet, so that the effect that the mixture of excrement and urine as well as sealing water continuously pumped out in front and clear water continuously and sequentially followed is achieved at the position of the S-shaped bend.

A water turbine and electric motor hybrid power suction type water-saving toilet, comprising a toilet main body and a power suction component, wherein the power suction component is a water turbine or an electric motor, and the water turbine or the electric motor is used as power to drive a rotating shaft to drive a propeller arranged below the rotating shaft to achieve a suction effect; an assembling component capable of dismounting and replacing the water turbine or the electric motor is arranged at a interface of the S-shaped bend so as to switch and install the water turbine and the electric motor; when the water turbine is used as power, the water inlet (42) of the hollow frame of the toilet is connected with a tap water pipe network through the water turbine; and when the electric motor is used as power, the toilet also comprises a water tank, and the water inlet (42) of the hollow frame of the toilet is connected with a water drain valve (82) at the bottom of the water tank.

A pressure energy relay device used for the above water turbine power suction type toilet, wherein the pressure energy relay device is installed at the joint of the tap water pipe network and the tap water inlet (13, 23, 49) of the water turbine.

wherein the pressure energy relay device comprises a pressure tank (61) and a tap water pipe network connector (63); the pressure tank (61) is a vertical tank body with a closed top and an open bottom, and is connected between the tap water pipe network connector (63) and the tap water supply valve (64) through the bottom opening of the pressure tank (61); and the tap water pipe network connector (63) is connected with the tap water pipe network, and a valve body water outlet (65) of the tap water supply valve (64) is connected with the tap water inlet (13, 23, 49) of the water turbine.

wherein the pressure energy relay device also comprises a water mask (62) arranged at an inlet below the pressure tank (61), the water mask (62) is a small cylinder with a closed upper part and a side wall windowed towards the periphery, and the opening in the lower part of the water mask (62) communicates with the inlet of the pressure tank (61).

What is claimed is:

1. Power suction type toilet, wherein a toilet main body of the toilet comprises a hollow frame, a hollow frame water inlet, and an S-shaped bend, wherein the hollow frame is located on an upper part of the toilet, and water injection holes are distributed in the hollow frame along a periphery towards an inner side of the toilet; the hollow frame water inlet is formed in a rear part of the toilet; and the S-shaped bend is located at a lower part of the toilet;

wherein the S-shaped bend is divided into five parts including an S-shaped bend inlet section, an S-shaped bend propeller position section, an S-shaped bend horizontal overflow port section, an S-shaped bend kettle belly accommodating body and an S-shaped bend connecting sewer pipe network section;

the S-shaped bend propeller position section is a conical pipe with a large upper part and a small lower part; the S-shaped bend horizontal overflow port section is an inclined circular pipe with one half cut into a horizontal overflow port, the cut half is cut to form a horizontal overflow port, and a non-cut half forms a flow deflector; an upper end and a lower end of the S-shaped bend kettle belly accommodating body are connected with an upper end and a lower end of the S-shaped bend horizontal overflow port section respectively; an inner diameter of the S-shaped bend kettle belly accommodating body is larger than an outer diameter of the S-shaped bend horizontal overflow port section; a cavity is formed between the S-shaped bend kettle belly accommodating body and the S-shaped bend horizontal overflow port section, and the cavity communicates with the S-shaped bend propeller position section through the horizontal overflow port, and meanwhile, communicates with the S-shaped bend connecting sewer pipe network section;

a rotating shaft of a power mechanism extends into the lower end of the S-shaped bend; and a propeller is arranged at the lower end of the rotating shaft of the power mechanism in the S-shaped bend;

the rotating shaft of the power mechanism is further provided with a funnel plugging body; the funnel plugging body is a circular sleeve with a slightly tapered lower part, an upper part lager and a lower part smaller, and with a bottom at the lower part; the funnel plugging body and the propeller are sequentially disposed on the rotating shaft of the power mechanism from top to bottom; and the lower part of the funnel plugging body is combined with the propeller, and the funnel plugging body and the propeller are integrated and rotate synchronously.

2. He power suction type toilet according to claim 1, wherein strip-shaped rubber fins are uniformly distributed on a periphery of a position, right opposite the S-shaped bend horizontal overflow port section, of the upper part of the circular sleeve of the funnel plugging body.

3. He power suction type toilet according to claim 2, wherein the upper part of the strip-shaped rubber fins straightly follows the circular sleeve, and the lower part of the strip-shaped rubber fins are bent around the circular sleeve towards one side with the same upward propelling effect as the propeller.

4. He power suction type toilet according to claim 2, wherein a component for mounting or dismounting the power mechanism is arranged at an upper port of the S-shaped bend kettle belly accommodating body, so that the upper port becomes an openable part of the S-shaped bend.

5. He power suction type toilet according to claim 4, wherein the power mechanism is an electric motor or a water turbine.

6. He power suction type toilet according to claim 4, wherein a basin bottom water injection hole is formed in the lower part of the toilet and communicates with the hollow frame water inlet through a pipe cavity attached to an outer wall of the toilet;

and a basin bottom water injection valve is further arranged at an opening, leading to the S-shaped bend, of the basin bottom water injection hole and controls connection and disconnection of the basin bottom water injection hole and the S-shaped bend inlet section with a water pumping process of the toilet synchronously.

7. He power suction type toilet according to claim 6, wherein the hollow frame water inlet does not communicate with the hollow frame directly at the rear part of the toilet, but is connected with the pipe cavity attached to the outer wall of the toilet, extends to a certain position from back to front along two sides of the toilet in a bilateral symmetry manner and then is divided into two paths respectively led upwards to the hollow frame and led downwards to the basin bottom water injection hole.

8. He power suction type toilet according to claim 7, wherein the power mechanism is an electric motor; the electric motor and a water tank are arranged at an upper part of the S-shaped bend kettle belly accommodating body located at the rear part of the toilet.

9. He power suction type toilet according to claim 8, wherein the toilet also comprises a control valve handle to realize synchronous control of the electric motor, a water drain valve of the water tank and the basin bottom water injection valve.

10. He power suction type toilet according to claim 9, wherein the control valve handle is a pedal valve handle or controlled by an electric button.

11. He power suction type toilet according to claim 7, wherein the power mechanism is a water turbine, the water turbine is arranged at the upper part of the S-shaped bend kettle belly accommodating body located at the rear part of the toilet, and a machine cabin for accommodating the water turbine is arranged.

12. The power suction type toilet according to claim 11, wherein a shell of the water turbine comprises a volute chamber for accommodating an impeller and a shaft retaining body for supporting an impeller rotating shaft, and the volute chamber and the shaft retaining body are fixed into a whole; the impeller comprises an impeller chassis, a blade and a blade upper cover which are fixed into a whole; the impeller rotating shaft is fixed on the impeller chassis, an upper part of the impeller rotating shaft extends into a shaft hole of the shaft retaining body, and a lower part of the impeller rotating shaft extends into the lower end of the S-shaped bend through the volute chamber of the water turbine; the impeller rotating shaft is provided with the propeller located at the lower end of the S-shaped bend; a tap water inlet is formed in a sidewall tangential to the volute chamber; the tap water inlet is connected with a tap water pipe network; a volute chamber water outlet is formed in one side of an upper part of the volute chamber from the shaft retaining body; and the volute chamber water outlet of the water turbine is connected with the hollow frame water inlet of the toilet.

13. He power suction type toilet according to claim 12, wherein the blade is a curved surface of which a generatrix is perpendicular to the impeller chassis; and the blade upper cover is a conical surface, so that a height of a water passage formed by adjacent blades is gradually increased from outside to inside.

14. The power suction type toilet according to claim 13, wherein the toilet also comprises a control valve handle to realize synchronous control of a tap water supply valve and the basin bottom water injection valve.

15. The power suction type toilet according to claim 14, wherein the control valve handle is a pedal valve handle or controlled by an electric button.

16. He power suction type toilet according to claim 15, wherein a pressure energy relay device is further installed at a joint of the tap water pipe network and the tap water inlet of the water turbine.

17. He power suction type toilet according to claim 16, wherein the pressure energy relay device comprises a pressure tank and a tap water pipe network connector; the pressure tank is a vertical tank body with a closed top and an open bottom, and is connected between the tap water pipe network connector and the tap water supply valve through the bottom opening of the pressure tank; and the tap water pipe network connector is connected with the tap water pipe network, and a valve body water outlet of the tap water supply valve is connected with the tap water inlet of the water turbine.

18. He power suction type toilet according to claim 17, wherein the pressure energy relay device also comprises a water mask arranged at an inlet below the pressure tank, the water mask is a small cylinder with a closed upper part and a sidewall windowed towards the periphery, and the opening in the lower part of the water mask communicates with the inlet of the pressure tank.

* * * * *